US006513789B2

(12) United States Patent
Kimura et al.

(10) Patent No.: US 6,513,789 B2
(45) Date of Patent: Feb. 4, 2003

(54) METHOD AND APPARATUS FOR SHORT-TERM RELINING OR CONSTRUCTION OF BLAST FURNACE

(75) Inventors: Kazuo Kimura, Tokyo (JP); Iwao Asada, Tokyo (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/752,860

(22) Filed: Jan. 2, 2001

(65) Prior Publication Data

US 2001/0000913 A1 May 10, 2001

Related U.S. Application Data

(62) Division of application No. 09/404,444, filed on Sep. 22, 1999.

(30) Foreign Application Priority Data

Apr. 30, 1999 (JP) ..... 11-123725

(51) Int. Cl.[7] ..... B66F 7/12
(52) U.S. Cl. ..... 254/89 H; 254/93 H; 29/281.1
(58) Field of Search ..... 254/89 H, 93 R, 254/DIG. 9, 133 R; 29/281.1, 281.5, 559

(56) References Cited

U.S. PATENT DOCUMENTS 4,064,616 A 12/1977 Kubota et al.
4,726,108 A * 2/1988 Poloni ..... 29/281.1
4,757,592 A * 7/1988 Reed ..... 29/559
4,796,346 A * 1/1989 Kawasaki et al. ..... 29/559
5,199,147 A * 4/1993 Whiteside ..... 29/281.1
5,201,112 A * 4/1993 Sevelinge ..... 29/281.1
5,383,652 A * 1/1995 Van Den Berg ..... 29/281.5
6,260,270 B1 * 7/2001 Kimura et al. ..... 29/890.031

FOREIGN PATENT DOCUMENTS

| | | |
|---|---|---|
| DE | 37 43 745 C | 5/1989 |
| EP | 0 182 511 A | 10/1985 |
| JP | 09 143521 | 6/1997 |

OTHER PUBLICATIONS

Fujita, et al., La Revue de Metallurgie, Paris, 96(3), Mar. 1999, 349–357.

* cited by examiner

*Primary Examiner*—Lee Wilson
(74) *Attorney, Agent, or Firm*—Schnader Harrison Segal & Lewis LLP

(57) ABSTRACT

Method and apparatus for short-term relining or construction of a blast furnace uses a grounding apparatus for grounding of ring-shaped blast furnace segments having shells and a casting floor present as a blast furnace floor for transferring the ring-shaped blocks or shells onto a foundation of the blast furnace, and capable of safely and precisely mounting the ring-like blocks on the casting floor, wherein the grounding apparatus is integrated with a jack system utilizing rod type lift jacks and a sliding apparatus installed with intermittently movable hydraulic cylinders for safe and precision mounting of the ring-shaped blocks or shells on the casting floor.

2 Claims, 19 Drawing Sheets

METHOD AND APPARATUS FOR SHORT-TERM RELINING OR CONSTRUCTION OF BLAST FURNACE

This application is a divisional of application Ser. No. 09/404,444, filed Sep. 22, 1999, incorporated herein by reference.

BACKGROUND OF THE INVENTION

1. Field of the Invention

The present invention relates to a precision method of short-term relining, constructing or reconstructing a blast furnace. Particularly, the method realizes significant shortening and simplification of the relining or construction process and reduction in cost.

2. Description of the Related Art

Conventionally, relining of a blast furnace is carried out by successively disassembling the blast furnace from top to bottom and thereafter successively assembling the blast furnace from the bottom to the top in reverse. In the disassembling and assembling operation, a furnace top crane is installed in the vicinity of the top of the blast furnace. However, the lifting capacity of the usual furnace top crane is only about 60 through 100 tons. Therefore, the disassembling and assembling operation requires dividing the blast furnace (hereinafter referred to as "shell") and its firebricks into a number of small units. Further, a time period as long as 120 to 150 days is required to complete relining. Further, work at a high elevation in the furnace is needed, posing a problem of safety. This is also a problem in newly constructing a blast furnace.

Japanese Patent Publication No. 39322/1978 proposes a method in which a blast furnace is divided into several sections or blocks extending from a furnace top portion to a furnace bottom portion, the divided blocks are successively assembled from the furnace top portion to the furnace bottom portion by the so-called "lift-up" method, and finally the furnace bottom portion is fixed onto a foundation of the blast furnace along with a furnace bottom base plate. Further, the respective divided blocks are preconstructed at a location other than the foundation of the blast furnace. Further, the assembling operation is carried out by utilizing an attached framework for constructing the blast furnace installed above the furnace tower.

Japanese Patent Publication No. 43404/1985 proposes a method in which a projected deck is attached to a furnace framework installed above the blast furnace tower, and a forwardly and rearwardly movable carriage is arranged on the deck. In the disassembling operation, the blast furnace is divided into several ring-like blocks from a furnace top portion to a furnace bottom portion. Blocks above the projected deck are moved out of the furnace by utilizing the carriage while successively conveying them down. Meanwhile, blocks below the deck are moved out of the furnace similarly by the carriage while successively conveying them up. Further, in relining the blast furnace is assembled by similarly utilizing the carriage on the projected deck in reverse of the disassembling procedure. This is a so-called "center drawing" method.

Japanese Patent Laid-Open No. 87907/1978 proposes a method of utilizing an operation floor installed at a furnace framework above the furnace tower similar to Japanese Patent Publication No. 43404/1985. In disassembling, portions above a tuyere portion are moved out of the furnace by utilizing a carriage while successively conveying them down. Meanwhile, portions below the tuyere portion are disassembled separately by bulldozers or the like. Further, in relining of the blast furnace, the portions below the tuyere portion are installed by conveying them down from the operation floor and portions above the tuyere portion are bonded while successively conveying them up. However, in this case, the assembling operation is carried out only in respect of the shell.

In all of the above-described conventional methods, no consideration is given to the delicacy of the complicated integral sections that comprise the shell, the brittle firebrick and the structure for maintaining the firebrick in place, or the warping or strain imposed upon the firebrick portions, or to the danger of deformation of the shell, which is caused by newly moving, assembling and placing the heavy divided blast furnace segments. Therefore, cracks are caused at bond portions of laid bricks owing to warping or strain or deformation of the shell in the moving and assembling operation. When the warping or the like is considerable, laid bricks tend to collapse. Further, there are problems of malfunction or destruction of attached measuring instruments and piping, and failure in bonding the separate integral blast furnace segments, which are sometimes called "ring-like blocks," or simply "blocks."

In the apparatus of Japanese Patent Publication No. 39322/1978, a problem is presented in which a jacking-up operation by hydraulic jacks installed at a furnace bottom base plate is indispensable in assembling or moving the furnace bottom. This requires the equipment and the operation to be complicated.

Further, according to Japanese Patent Publication No. 43404/1985 and Japanese Patent Laid-Open No. 87907/1978, the respective sections or blocks need to be removed and carried by utilizing the operation floor installed at the furnace framework above the furnace tower. Therefore, the operation is complicated and the investment cost is increased.

The applicants have previously developed a method of short-term relining or construction of a blast furnace capable of resolving the above-described problems, and have disclosed the method in Japanese Patent Laid-Open No. 143521/1997. Therein the occurrence of warping or straining of brickwork portions is effectively prevented, and roundness is essentially ensured in moving and assembling divided blocks. In this method, there is no need of jacking-up in moving and assembling the furnace bottom; all of the respective blocks are moved and hung up at the furnace foundation level and no operation floor or crane is needed. The existing furnace is disassembled and another blast furnace is reconstructed on the foundation thereof, or a totally new blast furnace is constructed. The method comprises the following steps:

1. The furnace is divided into several ring-like blocks from the furnace top portion to the furnace bottom portion.

2. The blocks are constructed at a location other than the foundation of the blast furnace.

3. Blocks other than the furnace bottom block are provided with means for preventing warping or straining of the brickwork portions and means for deforming the shell.

4. In respect of the furnace bottom block, bricks are laid on a furnace bottom plate installed at a lower end thereof.

5. Blocks other than the furnace bottom block are moved onto the foundation of the blast furnace by horizontal transfer.

6. Blocks other than the furnace bottom block moved onto the foundation of the blast furnace, are successively lifted up from the furnace top portion by the lift-up method and are bonded together to thereby constitute upper blocks.

7. The furnace bottom block is moved and installed onto the foundation by horizontal transfer at the blast furnace foundation level.

8. The furnace bottom block and the upper blocks are bonded together.

Occurrence of warping or straining at brickwork portions in moving, hanging up and bonding, can effectively be prevented. Further, the roundness of the furnace can substantially be ensured. Further, in assembling the respective blocks, when the entire brick-layers, electric instrumentation, piping, drying of the bricks and coating of the equipment and other steps are carried out, the relining or construction term can significantly be shortened to about 70 to 90 days. That is, simplification of relining or construction operation, as well as reduction in relining or construction cost, can be achieved.

Integrated iron and steel works, in recent times, tend to provide a production system in which extra facilities are not provided and the operational rate of aggregated facilities is promoted. Therefore, in blast furnaces which are limited to one or two furnaces in the entire iron and steel works, further shortening of the relining or the construction period is desired. However, according to the above-described methods, further shortening of this period is difficult to achieve. Many related facilities are installed around a blast furnace, and this becomes a troublesome and time-consuming operation in which existing attached facilities need to be temporarily removed and later installed again. That is, according to the relining and constructing methods disclosed previously, particularly in relining a blast furnace, a problem arises in which heavy integrated blast furnace segments cannot often be moved safely and smoothly onto a foundation of a blast furnace.

SUMMARY OF THE INVENTION

We have resolved the above-described problems by dividing the blast furnace into a plurality of very heavy generally cylindrical blast furnace segments, and by utilizing the casting floor that is present in the existing blast furnace as a floor for transferring the ring-like segments successively onto the foundation of the blast furnace. The casting floor is an operation floor located in a casting floor building that is provided with a molten pig iron trough for delivering molten pig iron to a pig iron receiving vessel, such as a torpedo car, arranged outside of the furnace.

The casting floor building is normally not provided with complicated and troublesome attached facilities for removal or installation of heavy components. Therefore, a super-heavy-weight article such as a blast furnace segment with its integrated shell, brickwork and associated components may normally only be mounted or transferred at the inside of the casting floor building. When the usual existing crane is used for the purpose, total destruction of the integrated segment is sometimes caused in the unloading operation alone, since excessive impact is applied to the shell and delicate brickwork. The crane cannot be stopped accurately at an exact predetermined position and the heavy ring-like segment and its shell and brickwork cannot be safely and precisely positioned on the casting floor.

Hence, we have been engaged in development of a novel grounding apparatus capable of safely and precisely positioning the ring-like block on the casting floor.

We have now created a novel grounding apparatus integrated with a jack system utilizing rod-type lift jacks and a sliding apparatus installed with intermittently movable hydraulic cylinders, which for the first time enable the operator to safely and precisely mount the very heavy blast furnace segments gently upon the casting floor.

Thus, safe transfer of the blast furnace segment, utilizing the casting floor building, is now made feasible. Therefore, short-term relining or construction or reconstruction of a blast furnace, utilizing the casting floor building, is realized for the first time.

We have provided a method of short-term relining or construction of a blast furnace, or disassembling an existing furnace and reconstructing a blast furnace on its foundation, or constructing a totally new blast furnace. Our method comprises the steps of:

- dividing the blast furnace into a plurality of generally cylindrical segments extending from a furnace top portion to a furnace bottom portion;
- constructing each of the blast furnace segments at a location other than the foundation of the blast furnace;
- installing attached facilities including staves and other attachments at each of the blast furnace segments while constructing them;
- jacking up each of the blast furnace segments to the casting floor level in the casting floor building by use of a grounding apparatus that extends between the inside and the outside of the casting floor building;
- laterally moving each of the generally cylindrical blast furnace segments already jacked up at the casting floor level, and mounting each of the blast furnace segments on a movable carriage installed on the casting floor;
- transferring each of the blast furnace segments to a furnace center position of the blast furnace by laterally transferring the movable carriage on rails laid on the casting floor;
- supportively hanging each of the integrated blast furnace segments by a plurality of jacks positioned at the top portion of the blast furnace tower at the furnace center position of the blast furnace;
- temporarily removing the rails at the furnace center position of the blast furnace and lowering each of the integrated blast furnace segments to position them on the foundation of the blast furnace to thereby form a lower portion of the furnace positioned below the casting floor;
- successively lifting up from the furnace top portion each of the integrated blast furnace segments from the furnace center position of the blast furnace for positioning a portion of the blast furnace above the casting floor level, using the jacks attached to the furnace tower and bonding together the successive blast furnace segments to form the upper portions of the blast furnace; and removing said load supporting members from said furnace position of said blast furnace and bonding the upper portions of the blast furnace with the lower portion of the blast furnace after forming the upper portions of the furnace;
- and removing the rails from the furnace center position of the blast furnace.

The following beneficial operations accordingly provide important advantages achieved by the invention:

I. Welding a shell of each blast furnace segment by one-side welding from outside the furnace.

II. Lifting up the blast furnace segments, combined with the bonding operation when the weld height of the one-side welding procedure reaches one-third of the plate thickness of the shell of the blast furnace segment, and carrying out the remaining welding after completing the lifting-up operation.

III. Extending ring-like shell reinforcement members through the centers of the blast furnace segments to horizontally span the shell surrounding the outer periphery of the integrated blast furnace segments, and engaging such shell reinforcement members with furnace inner structures, for attaching to the shell a stave which is highly useful in accelerating the construction process.

Further, according to this invention, there is provided an apparatus for relining or constructing or reconstructing a blast furnace, comprising:

- a steel structure that extends to the inside and to the outside of the casting floor building;
- a movable base mounted on rails cooperating with the steel structure, which base is movable back and forth between the inside and outside of the casting floor building;
- a moving apparatus for controlling movement of the movable base in a horizontal direction, and having hydraulic cylinders that are movable intermittently along the rails; and
- a grounding apparatus for grounding individual integrated blast furnace segments, having a hanging base movable up and down under forces exerted by a plurality of sets of rod-type lift jacks installed at the moving base and installed with hanging pieces for supportively hanging the integrated blast furnace segments.

These and other features of the invention will be further described in detail, and in the drawings, which show selected forms of the apparatus and the method, but which are not intended to define or to limit the scope of the invention.

DRAWINGS

FIG. 1 a vertical sectional view of an existing blast furnace before disassembling thereof;

FIGS. 7A and 7B show a grounding apparatus according to the invention, in which FIG. 7A is a side view and FIG. 7B is a plan view;

Figure 11:
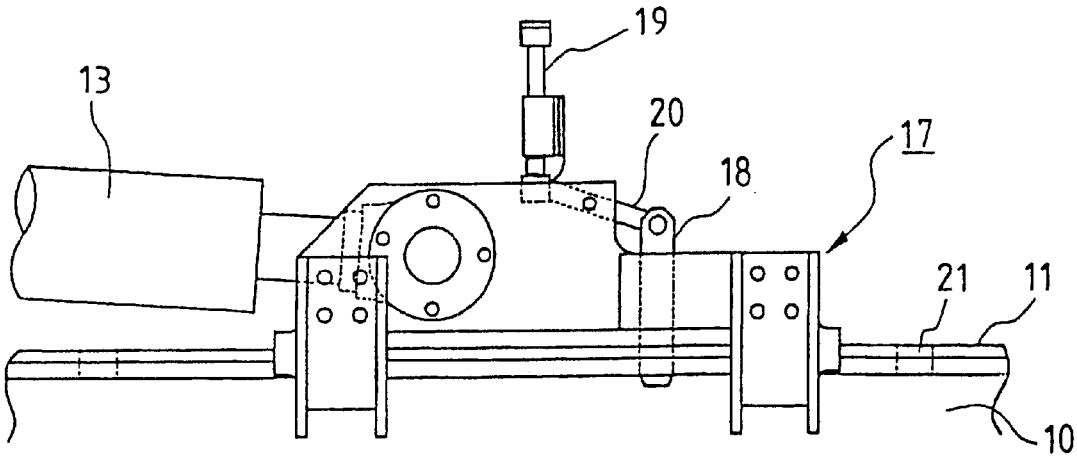
Figure 12:
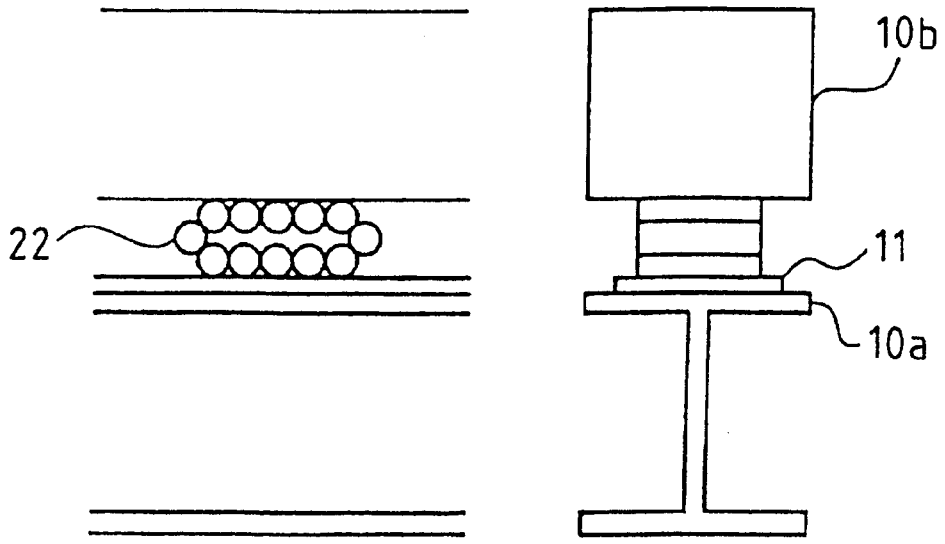
Figure 12:
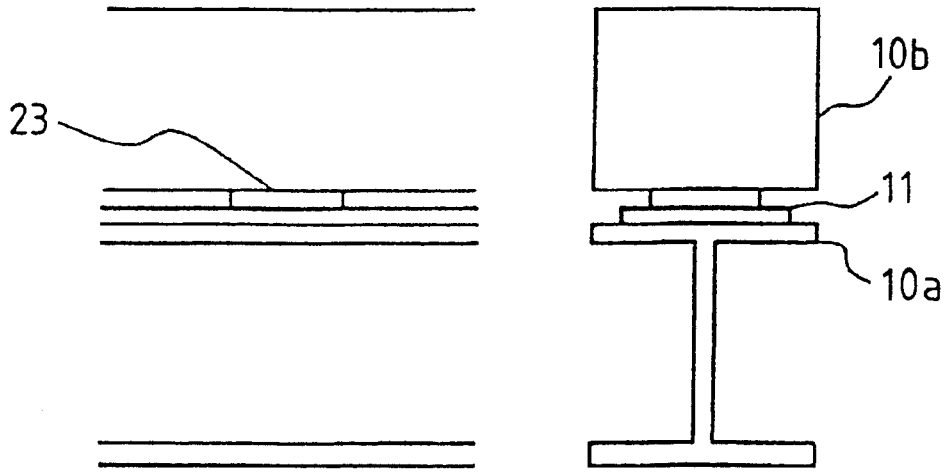
Figure 13:
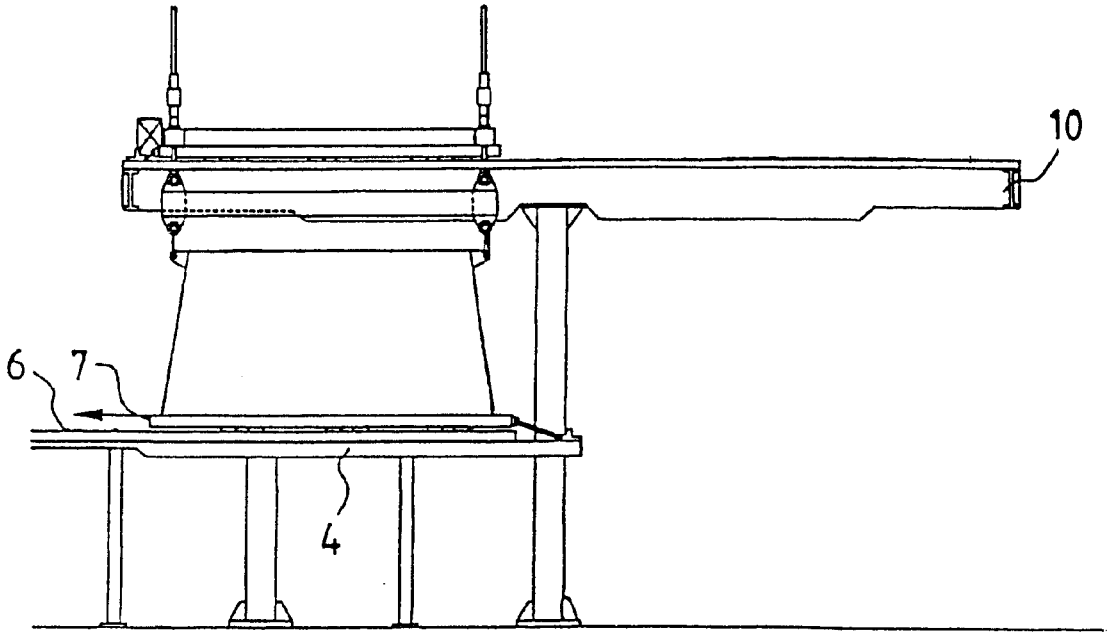
Figure 14:
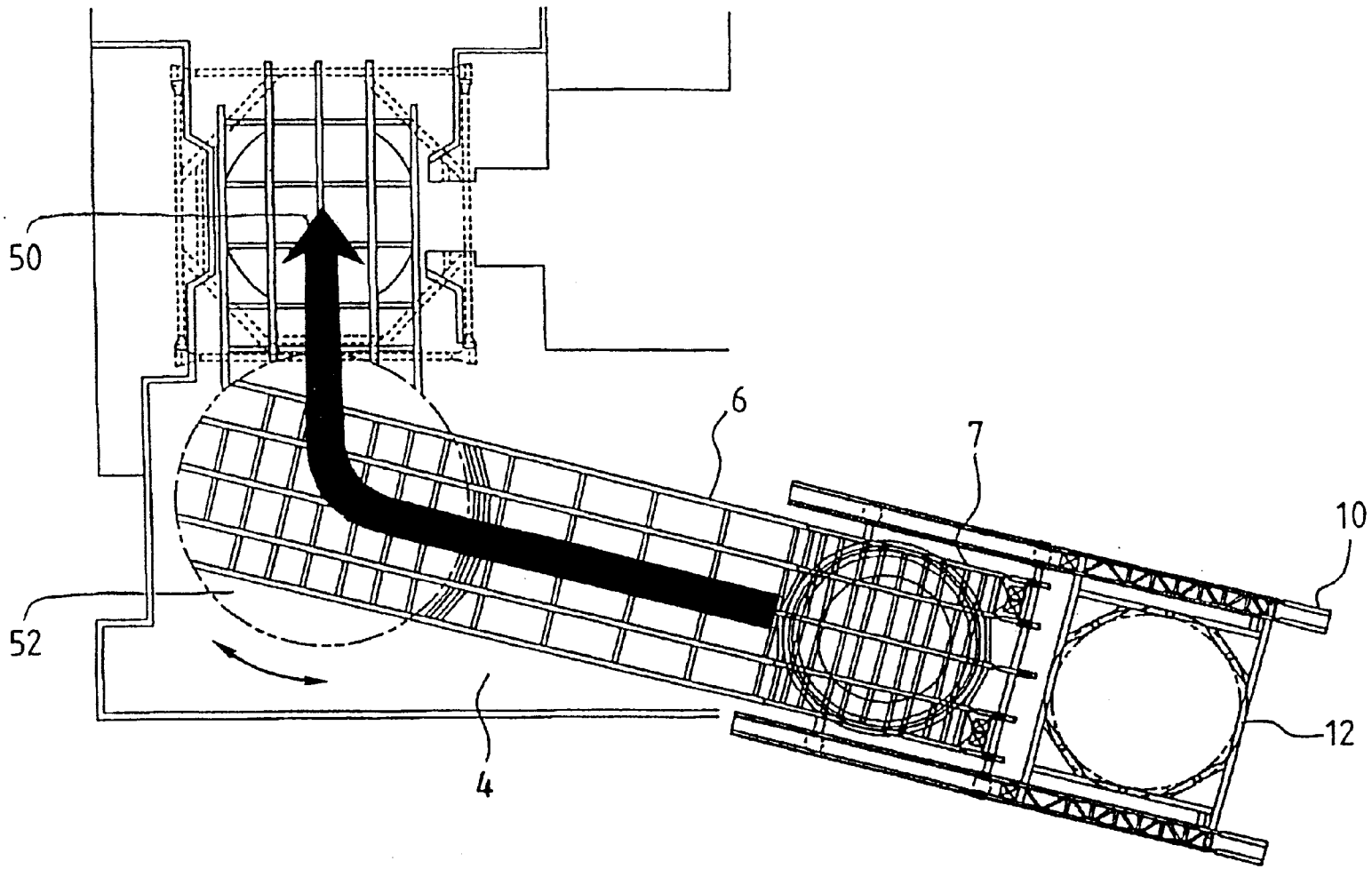
Figure 15:
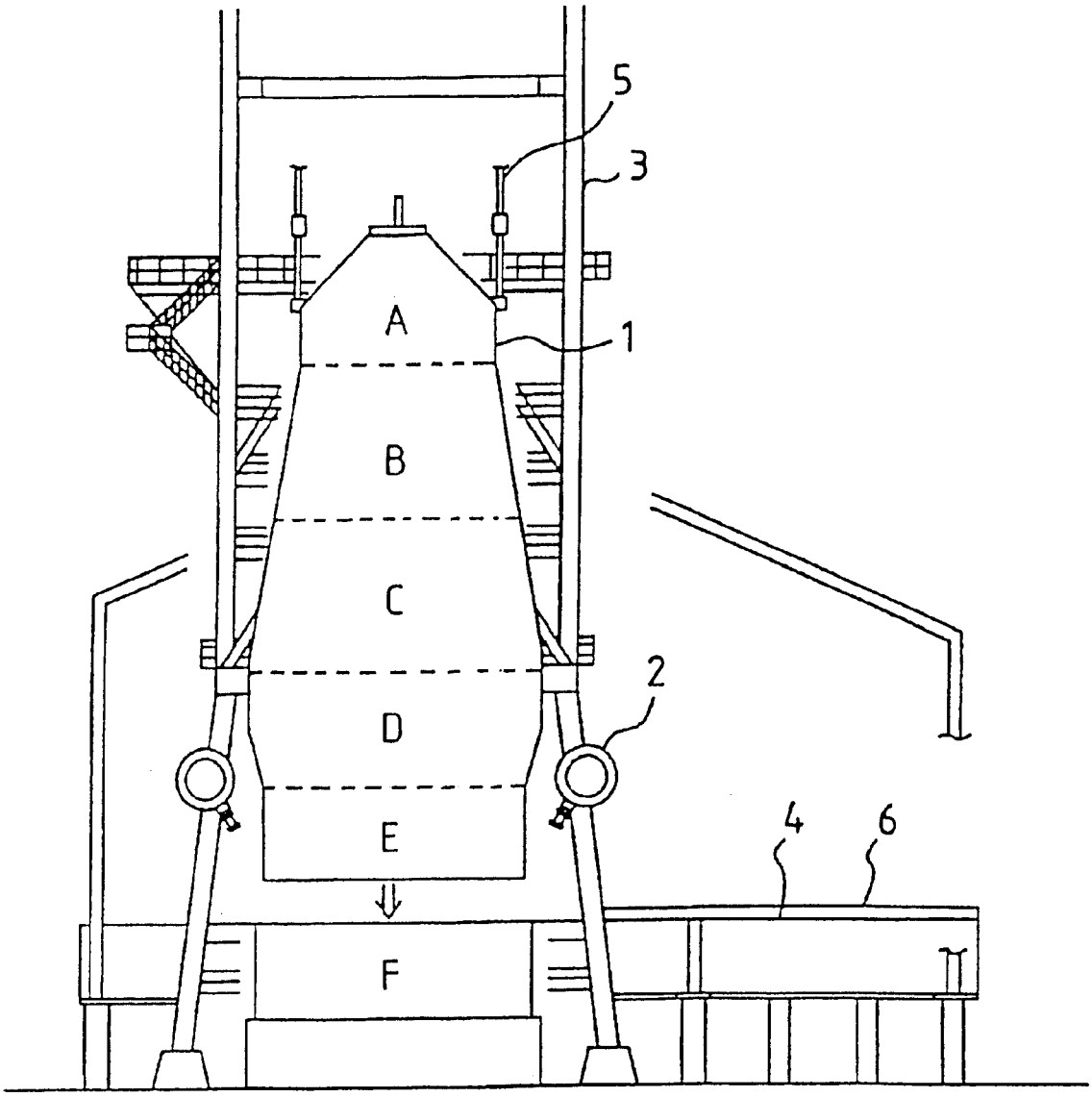
Figure 16:
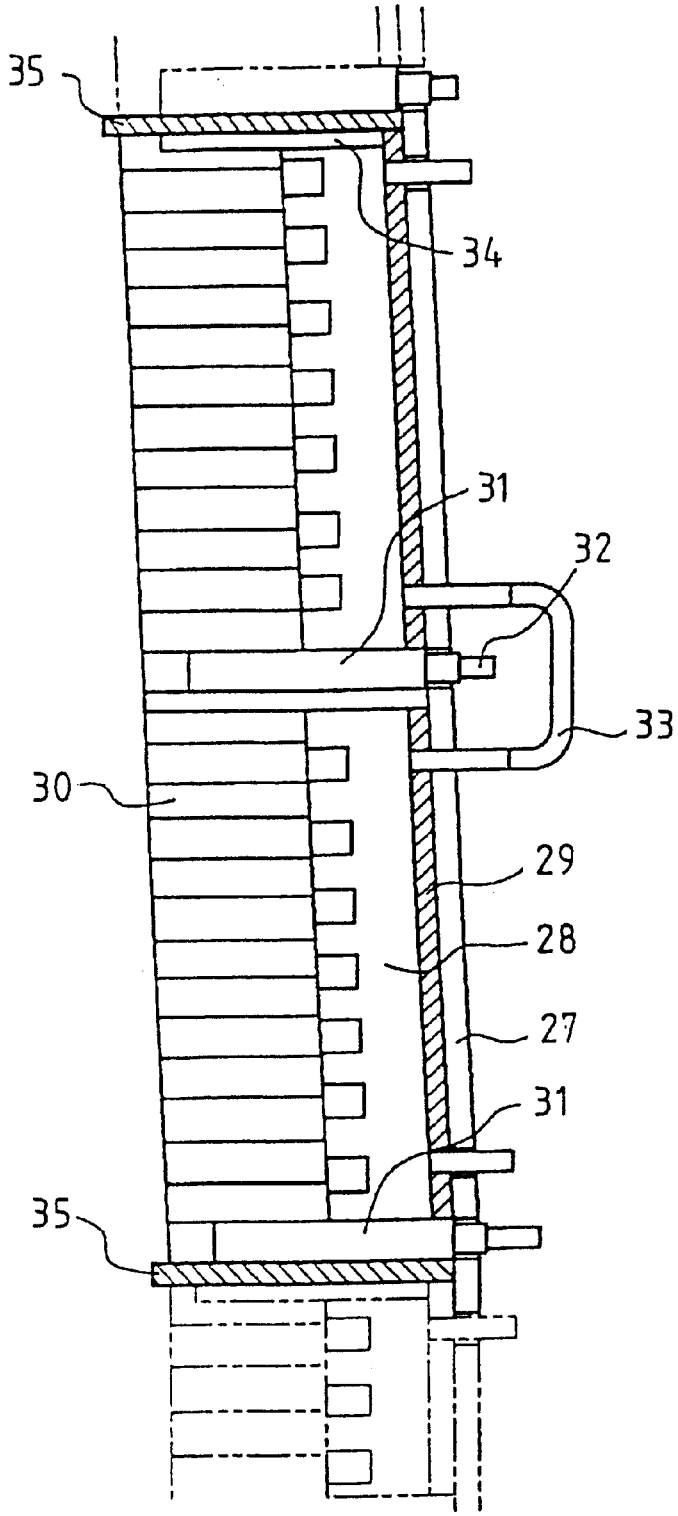
Figure 17:
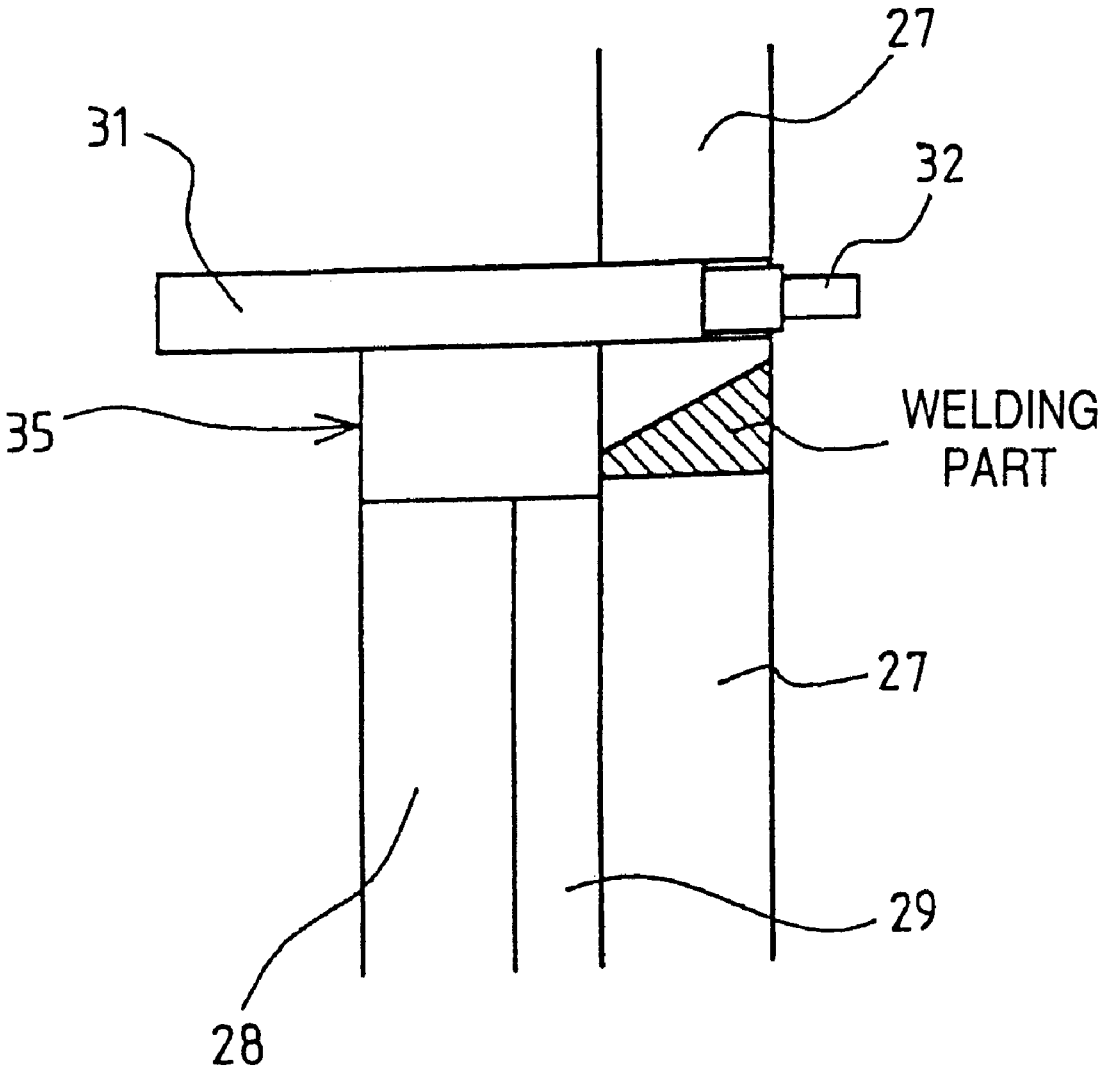
Figure 18:
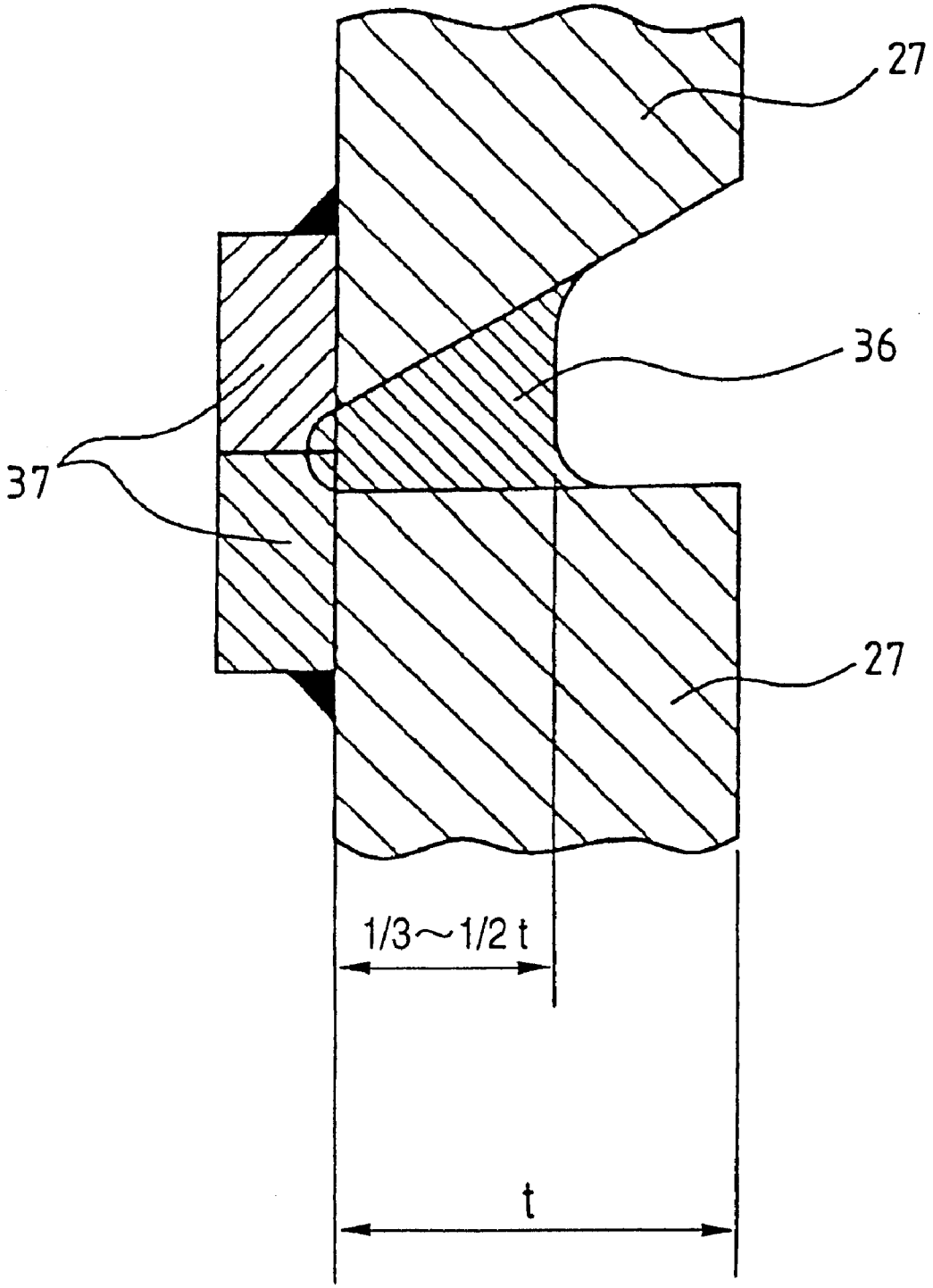
Figure 19:
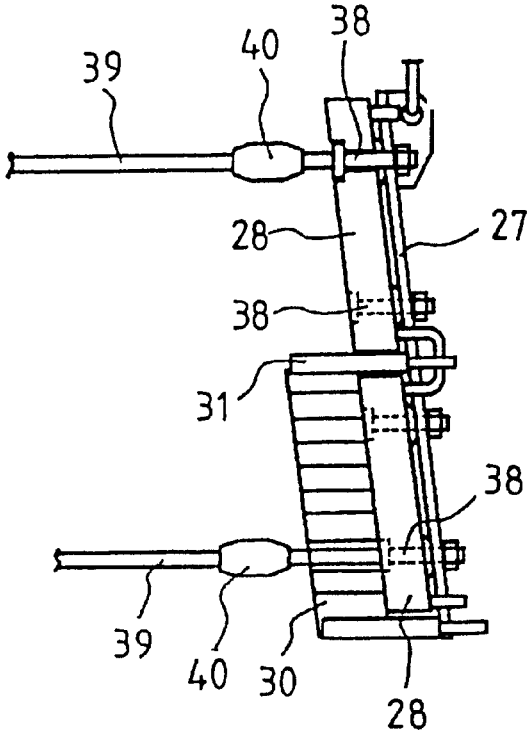
Figure 20:
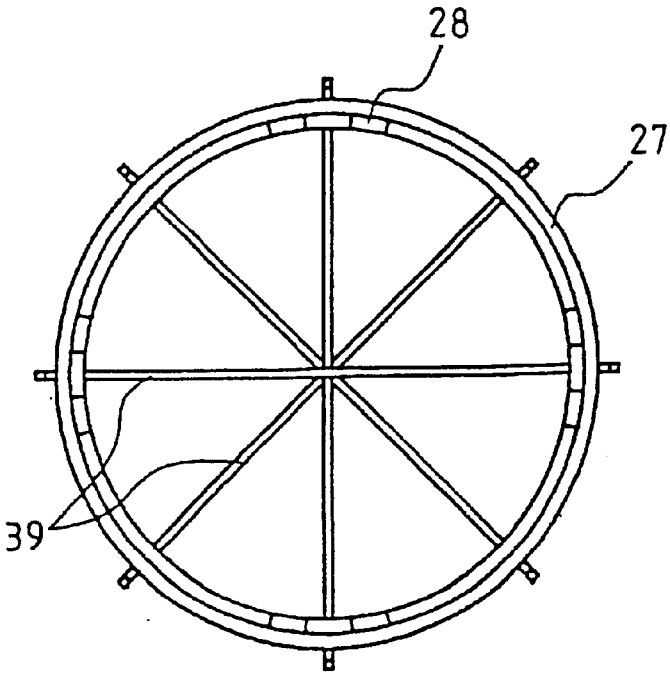

FIG. 11 a front view of a moving apparatus for fixing and releasing a hydraulic cylinder to and from a hanging structure in accordance with invention;

FIGS. 12A and 12B are views showing a preferred structure for smoothly moving a moving base on a hanging structure in accordance with this invention, in which FIG. 12A shows the use of rollers and FIG. 12B shows the use of a shoe;

FIG. 13 is a view showing a procedure for mounting an integrated blast furnace segment at an upper stage of a furnace onto a movement carriage above the casting floor by a grounding apparatus according to the invention;

FIG. 14 is a view showing an example of a usable route for transferring and grounding an integrated blast furnace segment on a casting floor at a furnace center position;

FIG. 15 is an explanatory view showing points of bonding an upper furnace portion A B C D E to a lower furnace portion F;

FIG. 16 is an explanatory view showing an inside portion of an integrated blast furnace segment in accordance with this invention mounted with brick supporting members, brick holding members and deformation prevention members;

FIG. 17 is an explanatory view showing points of bonding divided furnace segments together;

FIG. 18 is an explanatory view showing preferable points of welding to perform such bonding;

FIG. 19 is an explanatory view showing points of attaching shell reinforcement members to an shell of an integrated furnace segment; and FIG. 20 is a view showing attachment of shell reinforcement members to the shell of FIG. 19.

DETAILED DESCRIPTION OF THE PREFERRED EMBODIMENTS

A specific explanation will be given of a specific preferred relining operation of a blast furnace in accordance with the invention. Specific terms have been used for ease and clarity of explanation; they are not intended to define or to limit the scope of the invention, which is defined in the appended claims.

Prior to relining of a blast furnace, the existing blast furnace needs to be disassembled. The method of disassembling the blast furnace is not particularly limited. Any disassembling methods which have been carried out conventionally can be used. However, working at a high elevation poses a problem of safety and should be minimized.

First, an explanation will be given of a preferable method of disassembling a blast furnace.

Figure 1:
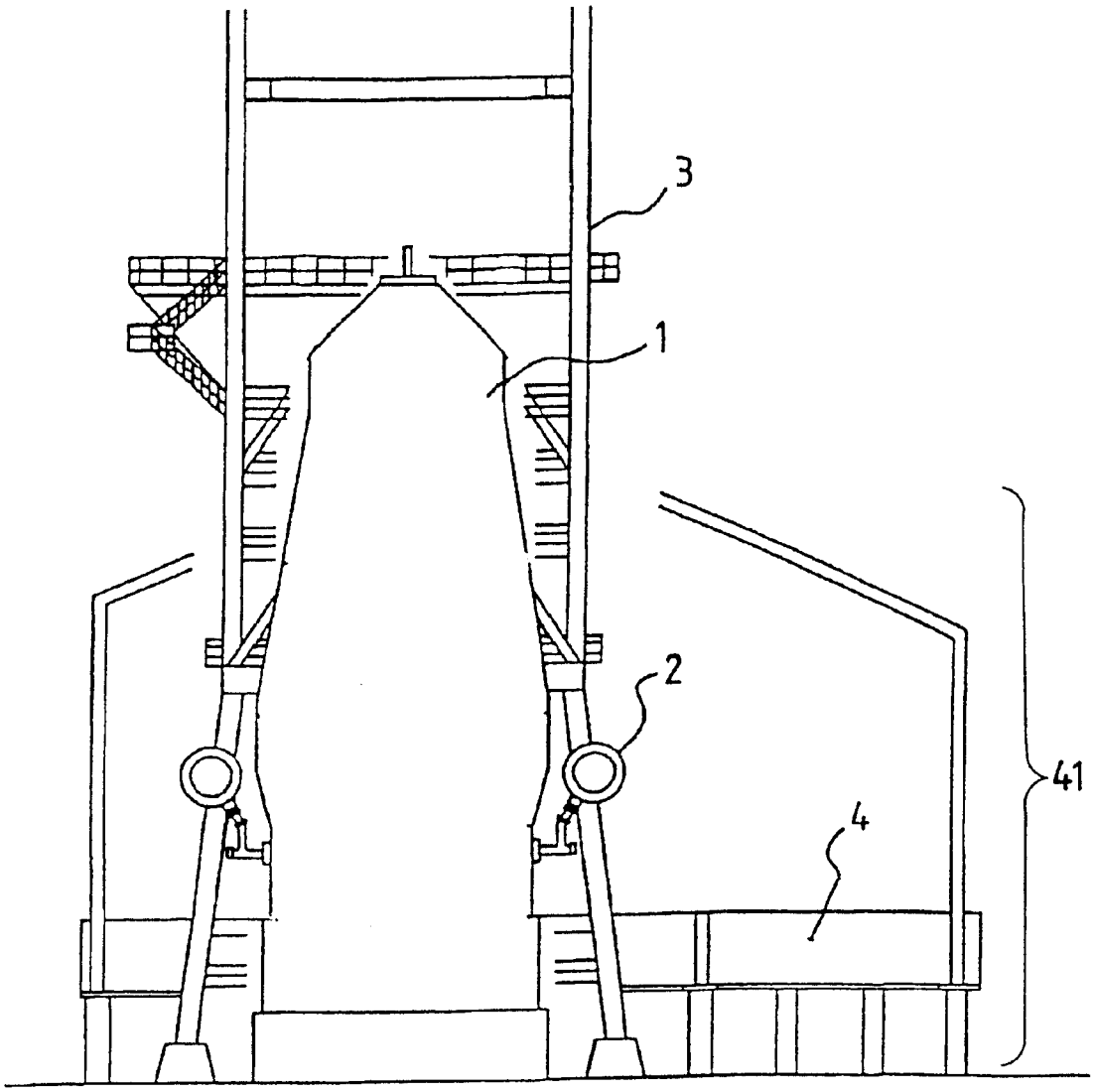

FIG. 1 is a vertical sectional view of a complete blast furnace. In the drawing, numeral 1 designates a furnace, numeral 2 designates a bustle pipe, numeral 3 designates a furnace tower, numeral 4 designates a casting floor and numeral 41 designates a casting floor building.

Figure 2:
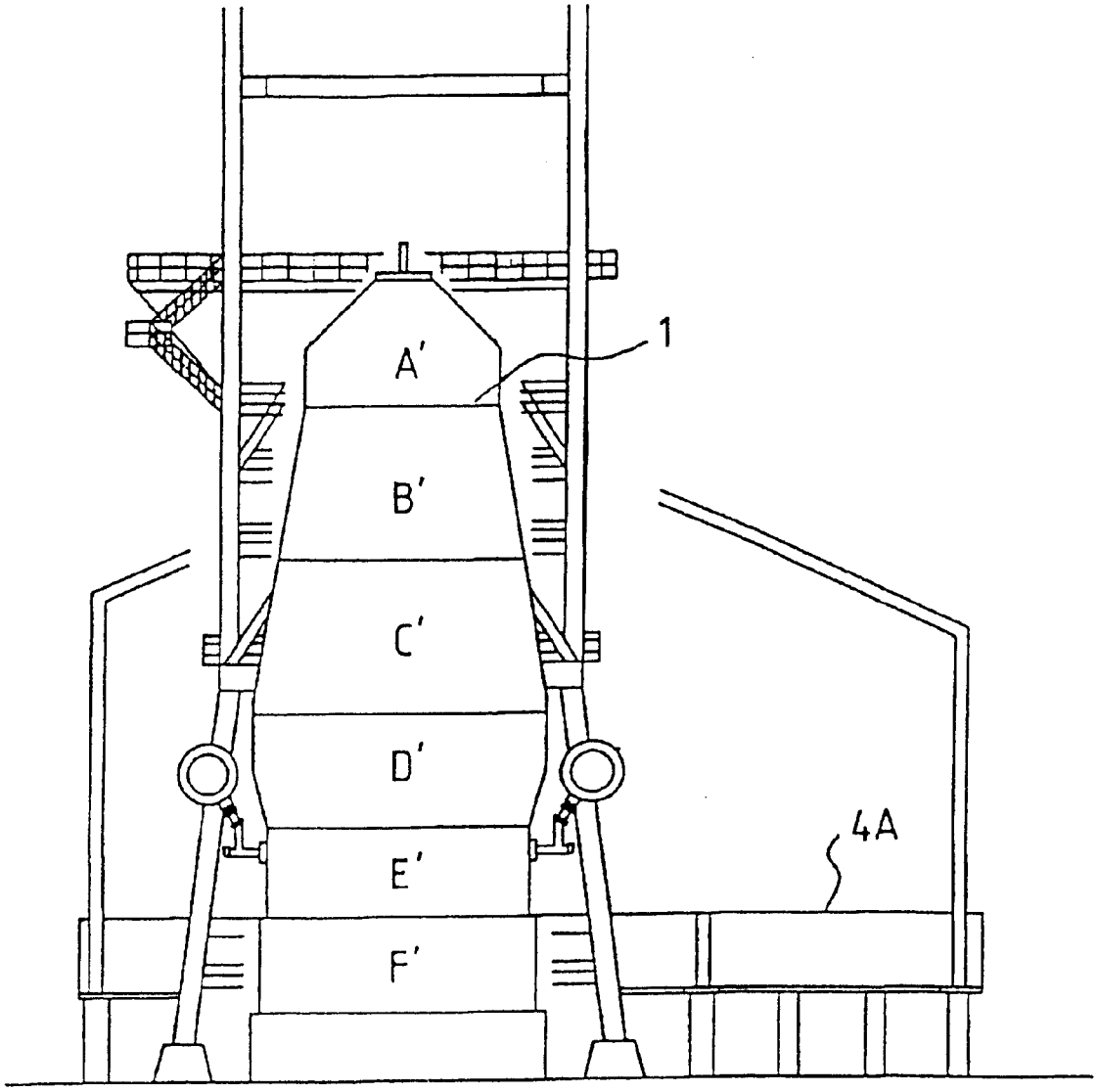
FIG. 2 is a view showing the blast furnace after being separated into a plurality of integrated segments A', B', C', D', E' and F' accordance with this invention.

As shown by FIG. 2, the furnace 1 is cut along a plurality of horizontal planes to divide it into a plurality of ring-like integrated blast furnace segments A', B', C', D', E' and F' . Each of the segments is kept integrated with the furnace bricks, the cooling facilities, the shell and sundry appurtenances. It is preferable to make a face cut between the furnace bottom block F' and the block E' just above it, flush with the level of the cast floor surface 4A.

Figure 3:
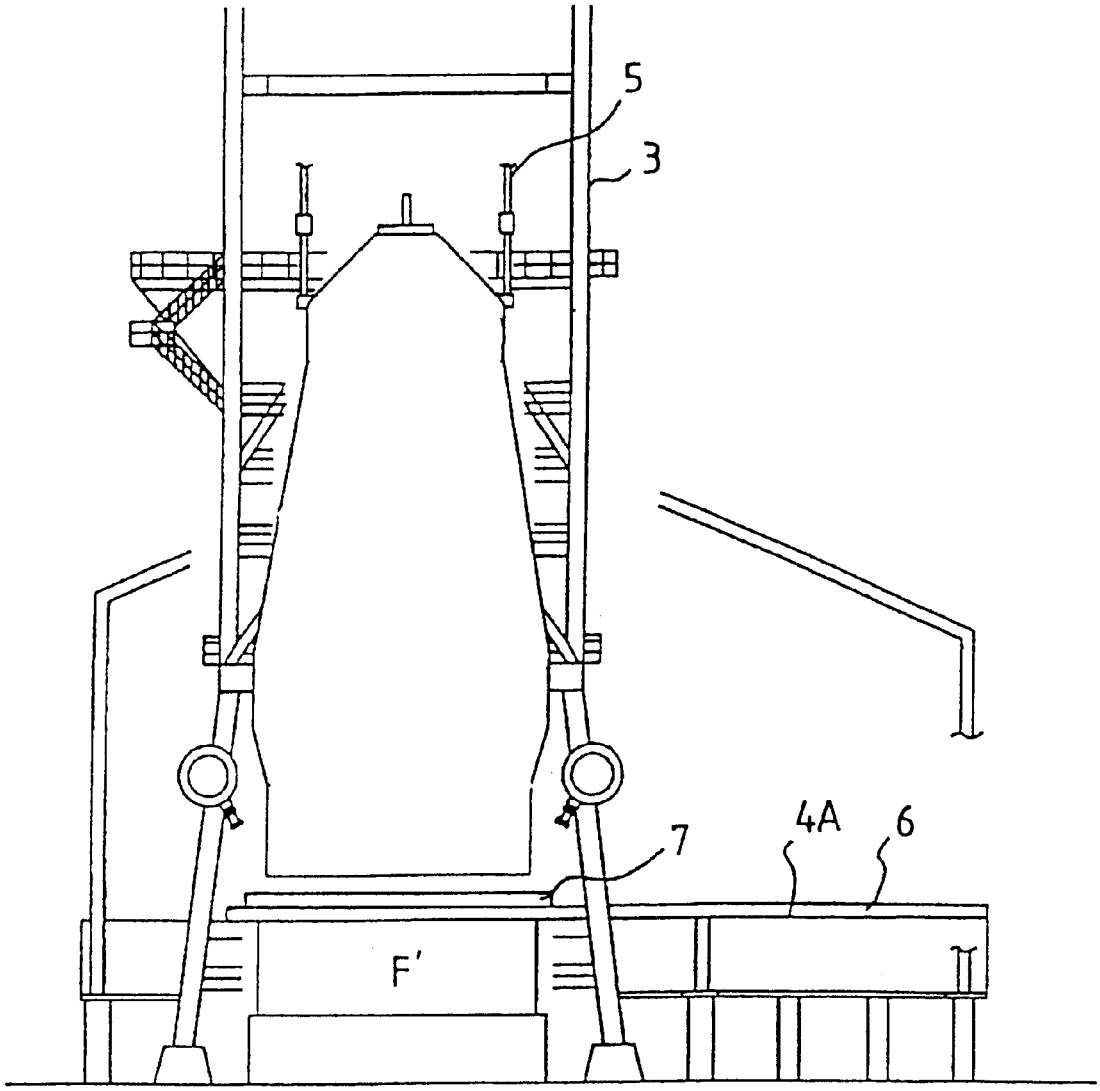
FIG. 3 is a view showing a procedure for separating the lowest stage segment F' of the FIG. 2 blast furnace in disassembling the blast furnace.

First, as shown by FIG. 3, the upper segments A', B', C', D', E' excluding the furnace bottom segment F', are hung up by a plurality of lifting rods 5 of a plurality of hydraulic jacks, which are used in a substantial number and attached to the furnace tower 3. Thereafter, a plurality of transfer rails 6 (FIG. 3) are laid on the upper face of the lowest blast furnace segment F' and upon the casting floor surface 4A. A movement carriage 7 is arranged upon the transfer rails.

Figure 4:
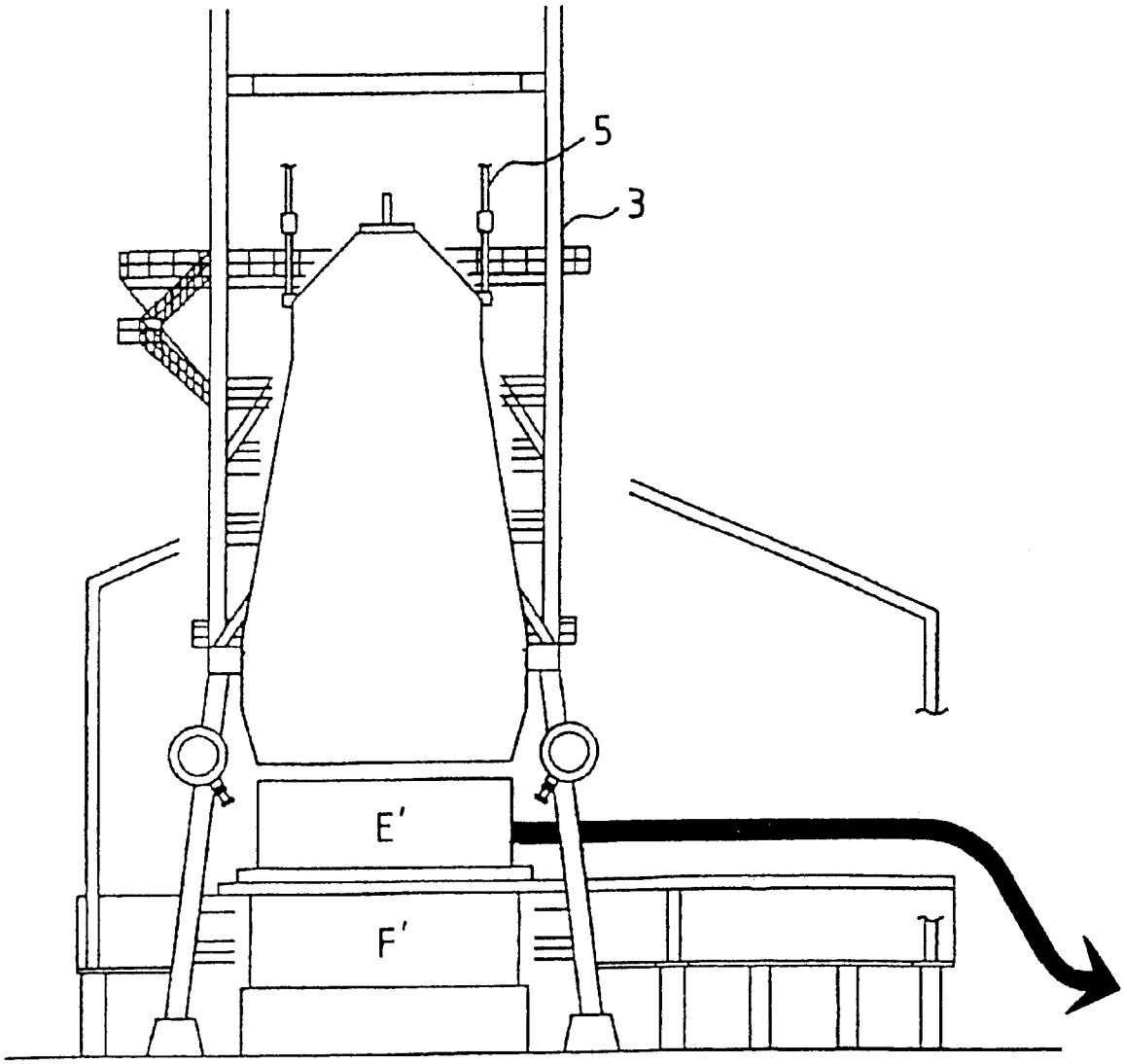
FIG. 4 is a view showing a procedure of dividing and moving out an upper stage integrated segment E' of the FIG. 2 furnace in disassembling it.

Next, the upper blast furnace segments are lowered by actuating the lift rods 5, and are placed on the rails 6 at the upper face of the lowest segment F'. The segment E' is separated from the remaining upper segments A', B', C' and D'. Further, as indicated by the arrow appearing in FIG. 4, the segment E' is horizontally moved on the rails, moved to an end portion of the casting floor and moved out of the casting floor building. Further, in separating the segment E' from the remaining ones of the upper segments, prior to the lifting operation, an shell cutting line capable of withstanding the weight of the segment E' is left, the segment E' is grounded on the rails at the upper face of the lowest segment F', and the segment E' is separated and cut.

These procedures are repeated and the segments E', D', C', B' and A' are successively disassembled and moved out. When the shell portion at the furnace top portion can be reutilized without major repair work, it can be reutilized without being moved out.

In disassembling the lowest segment F', a plurality of cut lines in the vertical direction are produced in the shell to thereby divide the lowest segment F' into a plurality of separate portions. The lowest segment F' is removed at the foundation level or hung up above the casting floor and removed in a manner similar to the upper segments. Bricks at the furnace bottom of the lowest segment F' are exposed to the outside after disassembling the shell. Therefore, the furnace bottom bricks are disassembled from outside by use of a large-sized disassembling machine and are thereafter lifted above the casting floor and removed.

After disassembling the existing furnace in this way, the blast furnace is ready to be newly reconstructed on its own foundation.

The furnace is relined or constructed as a plurality of integrated blast furnace segments. Each of the segments is previously separately constructed and is integrated in a ring-like shape. It may be constructed at a location remote from the foundation of the blast furnace. The example shown in the drawings is a case in which the furnace is assembled from six separate integrated blast furnace segments designated A, B, C, D, E and F. In assembling each of the segments, a shell is provided with an attached cooling facility of staves, cooling plates and so on, and castable refractory is flowed or stamped between the shell and the staves. Preferably, the inside of the furnace is finished drying at this stage. In supporting each of the segments, a space in which a moving facility can enter a lower portion thereof is maintained. Further, divided segments of the shell are aligned with lines dividing the staves.

Further, in assembling the respective segments, bricks can be laid on their inner faces along therewith. Because deformation of the shell is prevented by shell reinforcement members according to this invention, even when a portion or all of the bricks remain to be laid, transfer and bonding of the respective segments are nevertheless practical and feasible.

Further, in respect of the shape of the segment, although a ring-like shape is most preferable, other shapes may be used as necessary or desired.

Figure 5:
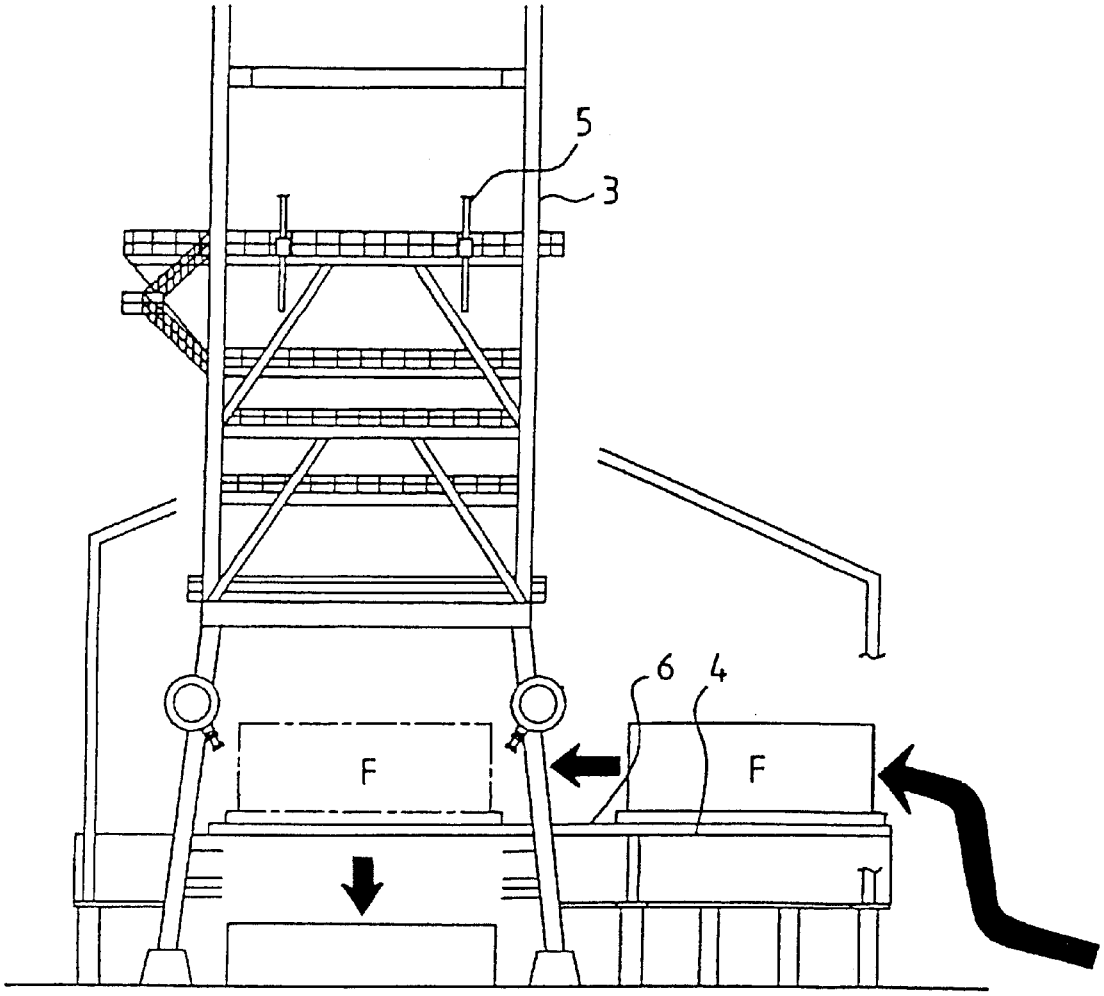
FIG. 5 is a view showing an initial step in a procedure for relining or reconstructing the blast furnace, by moving into the casting floor of the casting house a lowest stage blast furnace segment F and delivering it to a foundation of the furnace.

Turning now to the assembly method, following the arrow appearing in FIG. 5, the lowest stage segment F constituting a portion of the furnace at and below the casting floor level, is moved to the vicinity of the casting floor building, mounted on the casting floor, thereafter moved horizontally on a set of rails laid on the casting floor, moved to the furnace center position of the blast furnace and temporarily removed said load supporting members from said furnace position of said blast furnace, and successively hung down each of said blast furnace segments to install them on said foundation of said blast furnace to thereby form a lower portion of said blast furnace.

Figure 6:
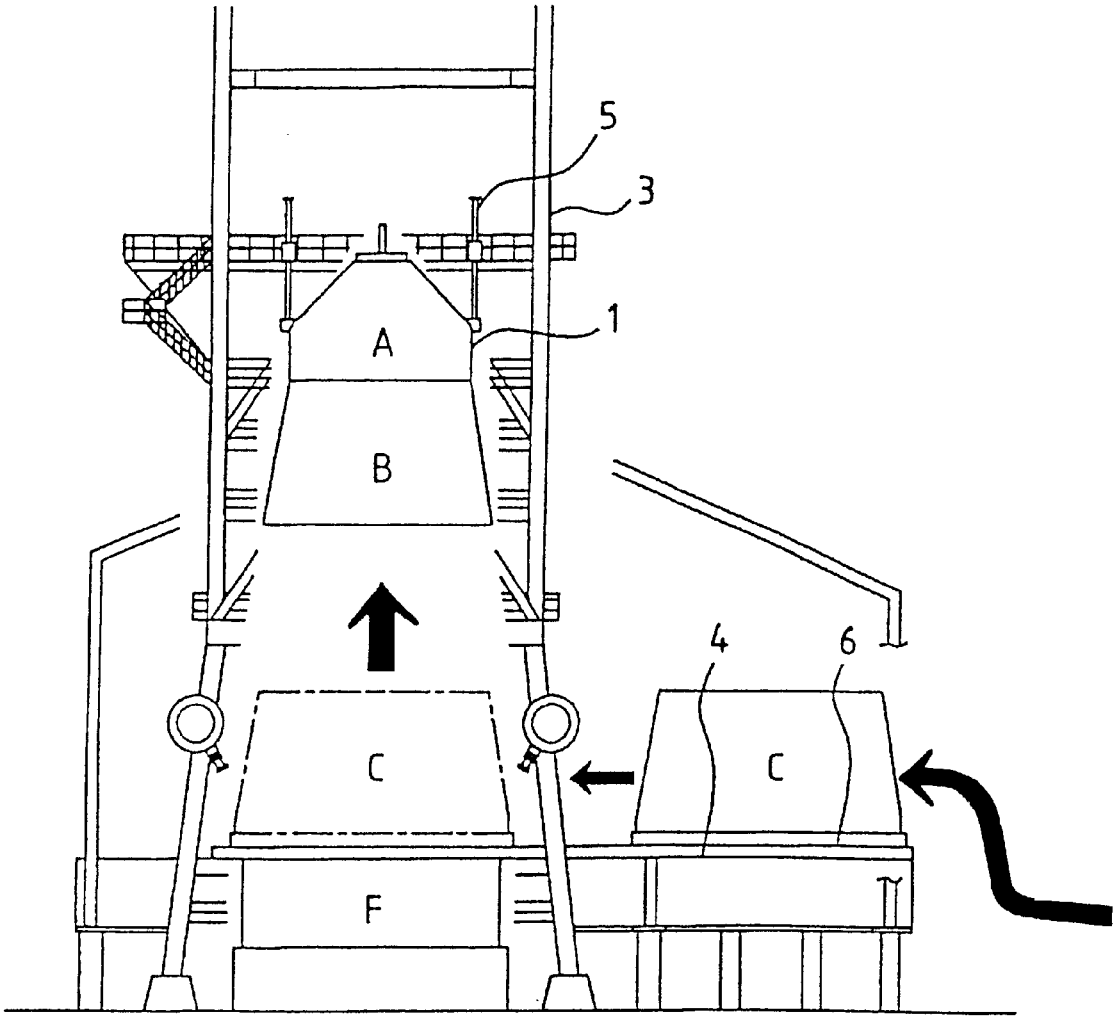
FIG. 6 is a view showing a procedure for moving in successively a plurality of integrated blast furnace segments and positioning them at upper stages of the furnace.

Successively, the individual blast furnace segments (A, B, C, D and E) constituting the portions of the furnace to be located above the casting floor level, are moved to the vicinity of the casting floor building, mounted on the casting floor, thereafter moved horizontally on the rails laid on the casting floor, moved to the furnace center position of the blast furnace, lifted up successively from the furnace top portion, and bonded together. FIG. 6 shows the block C being moved on rails 4 and then lifted according to the arrows.

It has been difficult to safely and precisely mount an integrated blast furnace segment having a weight exceeding 1000 tons on the casting floor by using a fixed-type crane, such as a tower crane or a mobile-type crane such as a gate-type crane.

In these cranes wires or cables are used as load supporting means. However, it is extremely difficult to horizontally move a heavy segment having extreme weight, since there are differences of elongations and lengths of the respective wires or cables. When the load cannot be controlled horizontally, varying forces are produced in unloading the segment, wherein a high load is locally applied and the delicate integrated segment may be damaged or even destroyed.

With these cranes, the mechanism of moving the load up and down is driven by rotating a wire drum by a motor. Stoppage accuracy, particularly in moving down, is poor. When the stoppage accuracy in moving down is not precisely controllable, impact is often applied in moving down the load, and the integrated segment may quickly be damaged or destroyed.

Further, particularly in the case of a gate type crane, its horizontal moving means uses driving wheels powered by a motor. Its stoppage accuracy in travelling is also poor. The load cannot be accurately stopped at a predetermined position, which results in a hindrance to the later steps, as will be readily appreciated.

Figure 7:
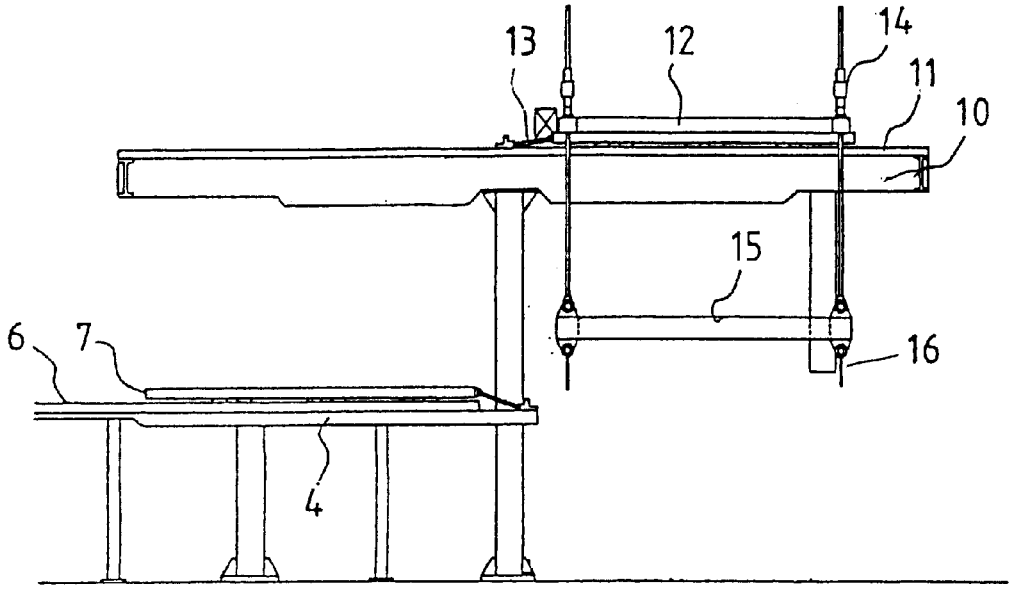
Figure 7:
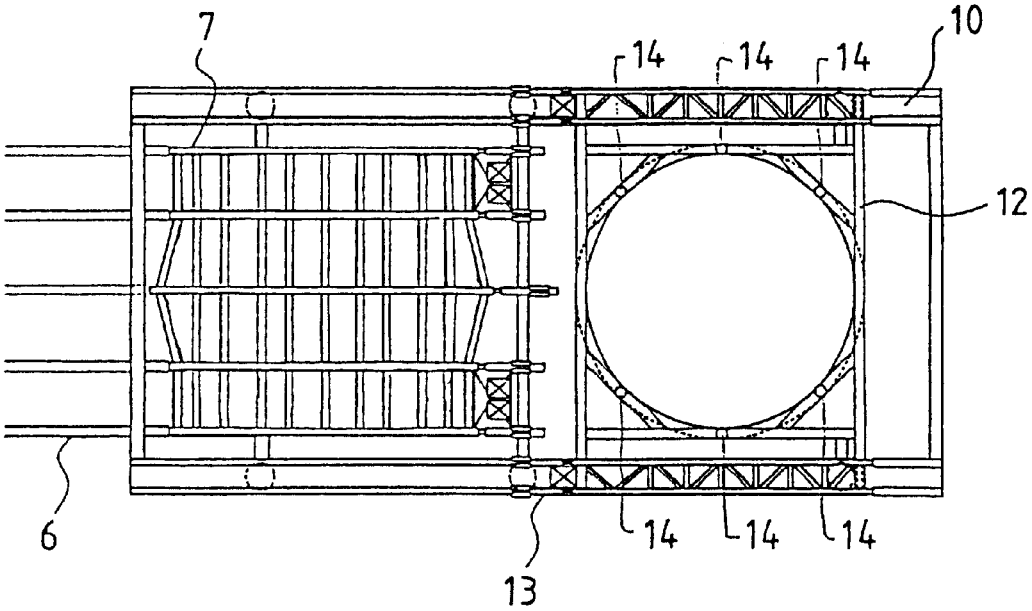

FIG. 7A is a vertical sectional view of a novel grounding apparatus according to the invention, and FIG. 7B is a horizontal sectional view thereof.

Numeral 10 designates a hanging structure which extends inside and outside of the casting floor building. Numeral 11 (FIG. 7A) designates a slide rail installed on the hanging structure 10 and a moving base 12 is horizontally movable along the hanging structure 10. Numeral 13 designates a hydraulic cylinder intermittently movable on the slide rail 11, numeral 14 designates a rod type lift jack, numeral 15 designates a hanging base and numeral 16 designates a hanger.

Figure 8:
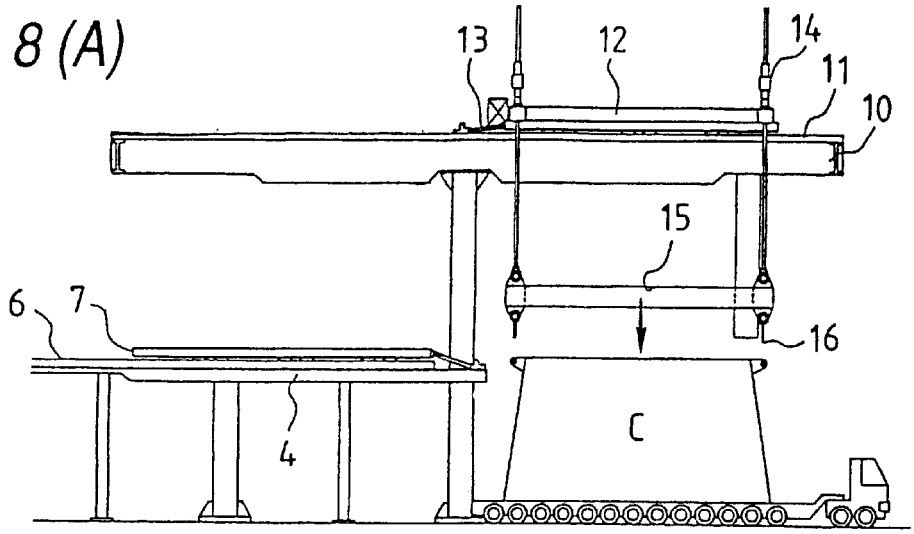
FIGS. 8A, 8B and 8C are views showing a procedure for hanging up a blast furnace segment C at an upper stage of the furnace, outside of the casting floor building, by grounding apparatus according to the invention.
Figure 8:
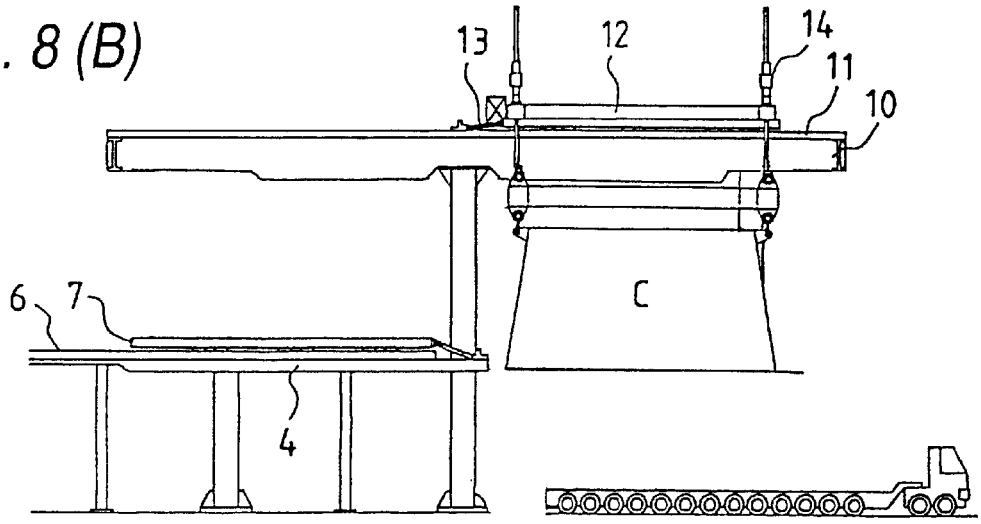
Figure 8:
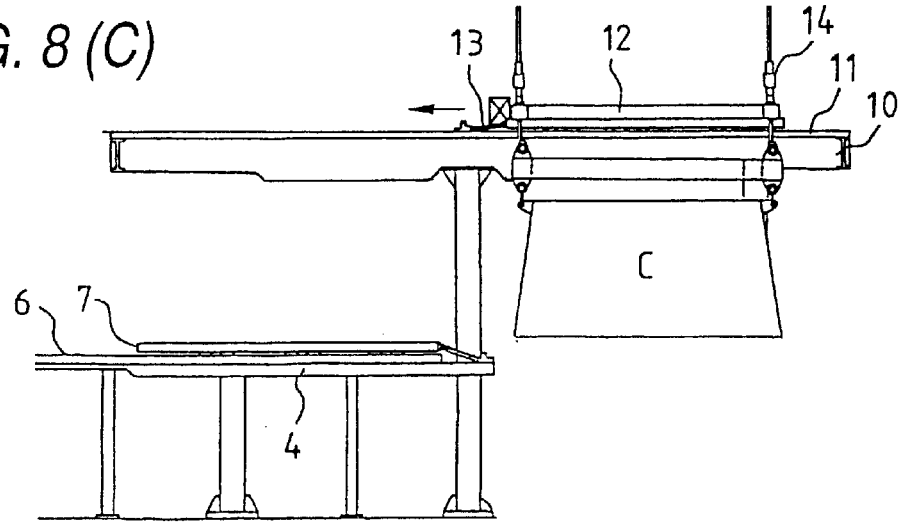

Hanging up the segment is shown in FIGS. 8A, 8B and 8C. First, the moving base 12 is on standby and is positioned outside of the casting floor building. The segment C, which with the other segments was constructed at a location other than the foundation of the blast furnace, is transported to the site by a trailer (FIG. 8A). The segment C is engaged by the hangers 16, lifted upwardly (FIG. 8B) and hung above the casting floor level (FIG. 8C). Further, the hangers 16 are attached to the hanging base 15 with the front ends thereof free. Engagement thereof is carried out freely in accordance with the size of each respective segment. After the segment C is engaged with the hangers 16, the hanging base 15 is lifted up by a jack system which provides equal distance and synchronized strokes at the respective hanging points, and with synchronous control of the positions and altitudes of the respective hanging points, such that the jack strokes for each of the respective hanging points are equal to each other. Therefore, each individual blast furnace segment always maintains a horizontal attitude without deviation of the hung load throughout each raising and lowering operation.

Figure 9:
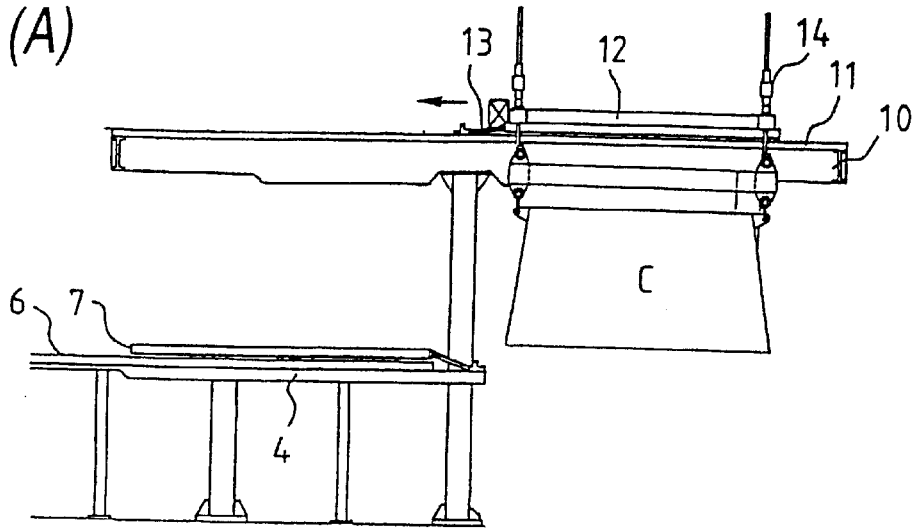
FIGS. 9A, 9B and 9C are views showing a procedure for horizontally moving the furnace segment C at an upper stage of a furnace, from outside of the casting floor building to inside the casting floor building, grounding apparatus according to the invention.
Figure 9:
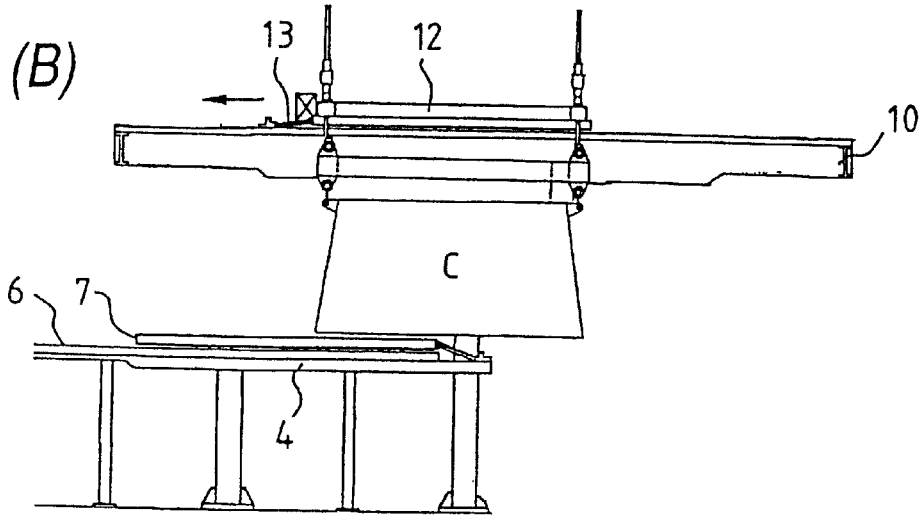
Figure 9:
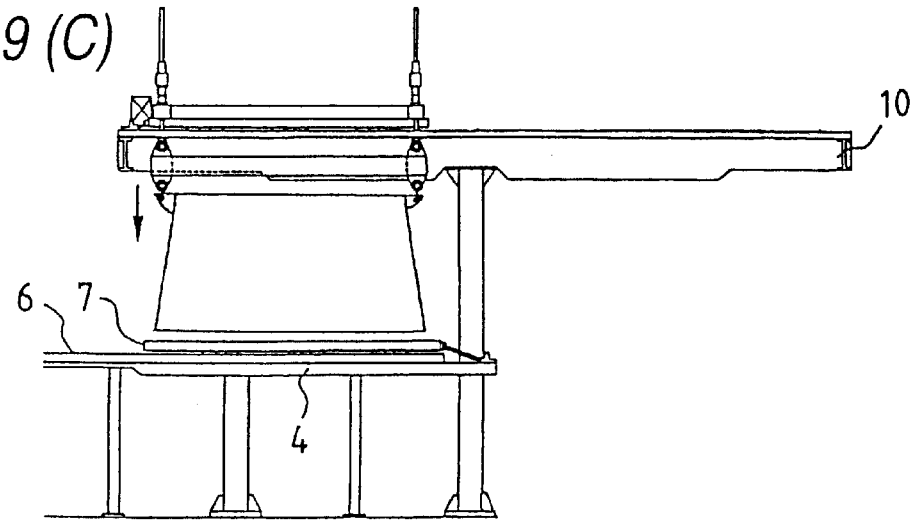

Horizontally moving the thus lifted heavy integrated segment is shown in FIGS. 9A, 9B and 9C. The segment C is hung above and beside the casting floor (FIG. 9A), horizontally moved toward a location above the casting floor, (FIG. 9B) and lowered onto the casting floor (FIG. 9C). The horizontal movement is carried out by moving the hydraulic cylinders 13 intermittently on the slide rails 11. In that manner, the horizontal movement (FIG. 9B) can be carried out smoothly and with excellent stoppage accuracy. The hydraulic cylinder 13 is provided with a structure capable of being freely fixed to and released from the hanging structure 10.

Figure 10:
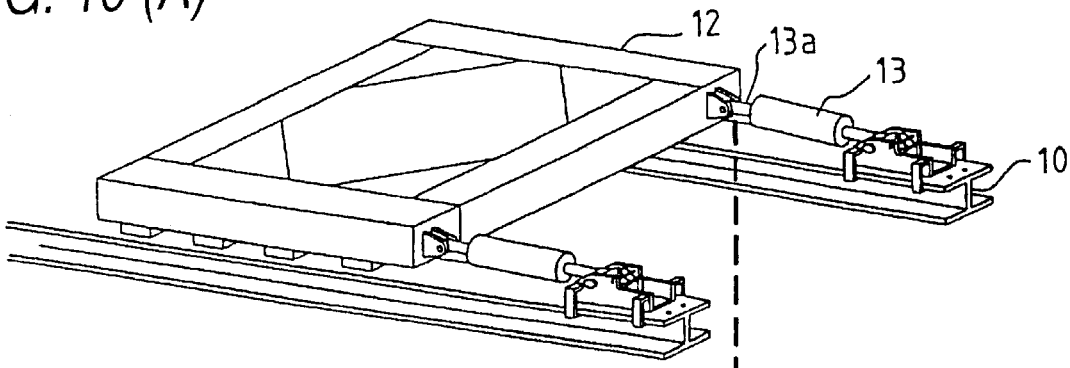
FIGS. 10A, 10B and 10C are views showing intermittent moving type hydraulic cylinders useful in achieving horizontal transfer of an integrated blast furnace segment such as segment C of FIGS. 9A, 9B and 9C.
Figure 10:
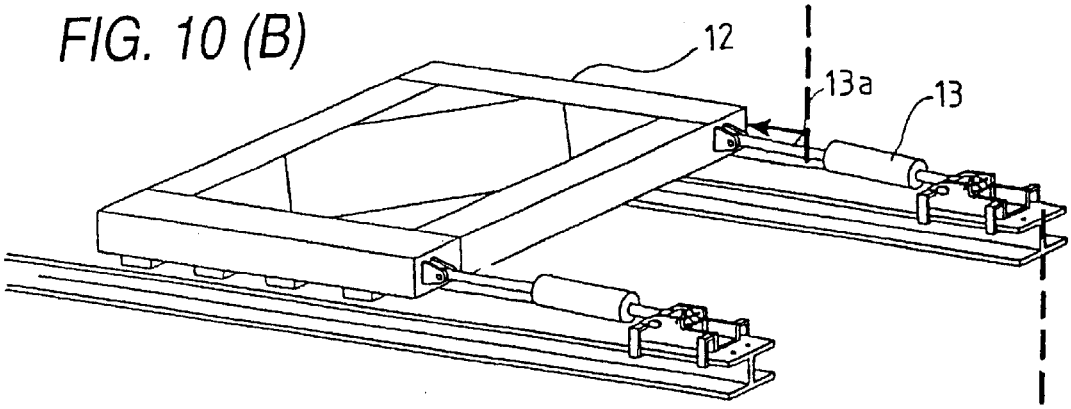
Figure 10:
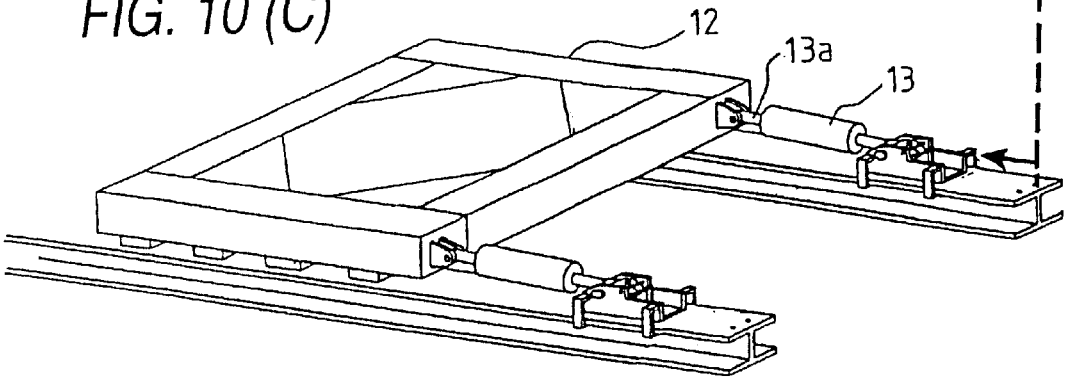

As shown by FIG. 10A, the hydraulic cylinder 13 is fixed to the hanging structure 10 with the cylinder rod 13*a* in a mostly contracted condition. The cylinder rod 13*a* can be gradually extended to make the movable supporting base 12 approach the casting floor in that amount (FIG. 10B). When the cylinder rod 13*a* is fully extended, the connection of the hydraulic cylinder 13 to the hanging structure 10 is released and the cylinder rod 13*a* is contracted. Then, as shown by FIG. 10C, on this occasion, the hydraulic cylinder 13 itself is moved toward the movable base 12 by that amount. When the hydraulic cylinder 13 maximally approaches the movable base 12, the hydraulic cylinder 13 is affixed again to the hanging structure 10. By repeating that operation, the movable supporting base 12 is smoothly moved under precise control in a succession of steps onto the casting floor.

Further, converse to extracting the cylinder rod 13*a*, by retracting the cylinder rod 13*a*, the movable supporting base 12 can also be moved accurately in the opposite direction.

The hydraulic cylinder 13 is fixed to or released from its associated slide rail 11 by using a structure shown by FIG. 11. In FIG. 11, numeral 17 generally designates the movable apparatus, numeral 18 designates a lock pin, numeral 19 designates a cylinder for driving the lock pin, numeral 20 designates a rotary lever and numeral 21 designates a lock hole of the lock pin 18 installed in the hanging structure 12. In pushing the movable base 12, when the lock pin 18 is driven by the driving cylinder 19 and fitted into the lock hole 21, the movable apparatus 17 and accordingly, the hydraulic cylinder 13 is fixed to the hanging structure 10. Meanwhile, when the hydraulic cylinder 13 is pulled back, the driving cylinder 19 may be driven again and engagement of the lock pin 18 with the lock hole 21 may be released.

Upon this occasion, control of the respective hydraulic cylinders is carried out synchronously by a single hydraulic unit. Therefore, there is no lack of uniformity in the moving speed of the movable base between the respective slide rails. Further, extremely precise speed adjustment can be carried out in respect of the hydraulic cylinder by simply adjusting the amount of oil it contains. Therefore, compared with the conventional style in which wheels are driven by a motor, the travel stoppage accuracy of this apparatus is remarkably precise. Accordingly, movement of the movable base and accordingly the segment C to a predetermined position can be carried out extremely accurately.

FIGS. 12A and 12B show a specific structure for smoothly moving the moving base on the hanging structure. Rollers are used in FIG. 12A and a shoe is used in FIG. 12B. In the drawings, the reference number 10*a* designates a rail-receiving hanging structure on which the slide rail 11 is installed. The reference number 10*b* designates a hanging structure on which the moving base 12 is devised to be mounted and horizontally moved. Further, numeral 22 designates rollers and numeral 23 designates a shoe and by interposing these between the slide rail 11 and the hanging structure 10*b*, the moving base 12 can be moved smoothly horizontally. In this case, a hard material is generally used for the roller and a resin-species used for the shoe.

Any heavy segment which has been moved horizontally to a predetermined position on the casting floor, is readily supportively hung by the above-described jack system and is mounted on the moving carriage 7 installed on the casting floor (FIG. 13). In the hanging operation, according to the jack system of the invention, the integrated blast furnace segment can be hung down while maintaining a horizontal attitude. Accordingly, there is no concern that interference will be produced in the hanging down operation, or that a high load will be applied locally, or that the integrated segment will be damaged. Further, the stoppage accuracy of downward movement is extremely excellent.

The segment mounted on the moving carriage 7 is transferred to a furnace center position 50 (FIG. 14) by moving on the rails 6 for transfer, as shown by the arrow in FIG. 14. Although as moving means, a method using the rollers 22 or the shoe 23 shown by FIGS. 12A and 12B is particularly preferable, compared with the hanging operation from outside of the casting floor building to inside the casting floor building, less precision is needed and therefore, a wheel type carriage may be used. Further, FIG. 14 relates to movement of the segment on the casting floor. Direction of movement may be changed by a moving turntable 52 (FIG. 14). However, this is only an example and direction change is not necessarily needed.

With the creation of such a grounding apparatus, a heavy yet delicate blast furnace segment constructed at a location other than the foundation of the blast furnace can be safely and precisely grounded on the casting floor. As a result, each successive segment can be bonded to those above it and short-term relining or construction of a blast furnace, utilizing the casting floor, has been achieved.

As shown by FIG. 15, after transferring the final segment E to the furnace center position, the rails at the furnace center portion are removed, the bonded upper portions A–E of the furnace are hung down and the upper portions of the furnace and the lower portion F of the furnace are bonded together to thereby finish relining of the blast furnace. The time for relining can be shortened to 60 to 70 days.

It is preferable for the invention to provide the blast furnace segments with means for preventing warping or straining of bricklaying portions and for preventing deformation of the shell. According to a preferred embodiment, in respect of upper segments A–E except the furnace bottom portion F, there are provided at least brick supporting portions at a lower end of the segment and/or brick holding portions at an upper end thereof. It is further preferable to install deformation preventing members at some or all of the upper and lower ends and the inside of the segment.

Further, when staves are utilized as means for preventing warping or straining at such a bricklaying portion and/or means for preventing deformation of an shell, such staves are preferably utilized.

Further, in respect of the furnace bottom portion block F, a furnace bottom plate is installed at the bottom, essentially preventing warping or straining and deformation of the shell. Therefore, there is no particular need of installing brick supporting members, brick holding members and deformation preventive members.

FIG. 16 shows a preferred embodiment of a blast furnace segment provided with brick supporting members, brick holding members and deformation preventive members. In the drawing, numeral 27 designates an shell, numeral 28 designates a stave, numeral 29 designates castable refractory injected between the shell 27 and the stave 28, numeral 30 designates firebricks, numeral 31 designates a cooling plate, numeral 32 designates a cooling plate pipe, numeral 33 designates a stave connecting pipe, numeral 34 designates a brick holding metal piece and numeral 35 designates monolithic refractory interposed at bond portions among the respective blocks. According to this example, the cooling plates 31 are installed at a central portion and a lower end of the block and the cooling plate 31 at the lower end also serves to support the bricks. Further, the brick holding metal piece 34 is provided with high bending rigidity since the shape is a doughnut shape. Therefore, by installing such a doughnut plate at an upper end of the segment, the doughnut plate functions not only as a brick holding member but also as a deformation preventive member. This example is a case in which the cooling plate 31 at the lower end serves to support bricks and the brick holding metal piece 34 serves as the deformation preventive member. Even when these members are installed respectively and individually, there poses no problem.

By installing such brick supporting members, brick holding members and deformation preventive members at the blast furnace segment, occurrence of warping or straining at bricklaying portions can effectively be prevented in carrying, hanging up and welding the respective segments. At the same time, prevention of deformation of the shell of the segment is essentially ensured. Further, when the bricks are not laid in a blast furnace segment, the brickholding metal pieces are not necessarily needed. However, it is further advantageous to install the brick holding metal pieces for preventing deformation.

According to the invention, bonding of the respective segments is carried out by one side welding of the shell from outside of the furnace and therefore, welding within the furnace is not needed. Further, it is important to align the bonding face of the staves with a face bonding the shell on the spot. In this case, as shown by FIG. 17, to provide one-side welding of the shell, grooves for one-side welding are provided at a lower end of the shell 27 of the upper segment and an upper end of the shell 27 of the lower segment and welding is carried out from outside. In this way, according to the invention, filling gaps among the segments and bonding the shell can be carried out from outside of the furnace and therefore, processing in the furnace can significantly be reduced, which is preferable for reasons of safety, saving of construction expense and shortening of the term.

As shown by FIG. 18, it is preferable to lift up the blast furnace segment at a time when the weld height of the one side welding of the shell from outside of the furnace is completed to the extent of at least ⅓ of the plate thickness of the shell, and to carry out the remaining welding operation after completing the lift-up operation. The plate thickness of the shell is designed to withstand the inner pressure in operating the blast furnace and accordingly, the bond portion in hanging up the shell does not need a dimension of the weld portion which is equal to the thickness of the shell. Therefore, in lifting up the segment, a weld height only to avoid breaking the weld under the lifting up operation is sufficient. According to stress analysis it has been found that the weld height needs to be at least ⅓ of the plate thickness of the shell. Further, at the lower portion of the furnace, the shell is comparatively thick and accordingly, the weld height is sufficient when it reaches about ⅓ of the plate thickness of the shell. The thickness of the shell at an upper portion of the furnace is usually less than that in the lower portion of the furnace and accordingly the weld height is preferably equal to or more than ½ of the plate thickness of the shell. In FIG. 18, the numeral 36 designates a weld metal and numeral 37 designates a backing metal. As a result, the time for welding the segments can significantly be shortened, the standby time period before lifting up a successive segment can be halved and accordingly, shortening of the relining or construction term can be achieved.

Further, with the purpose of preventing deformation of the shell surrounding the outer periphery of a constructed ring-like segment, the ring-like shell reinforcement members passing through the center of the segment are attached to span horizontally. In this case, it is preferable to engage an end portion of the shell reinforcement member with an end portion of a metal piece on the inner side of the furnace for attaching the stave to the shell. As a result, removal of the shell reinforcement member from the segment is facilitated and the relining term can be shortened by that amount.

FIG. 19 is a vertical fragmented sectional view of a blast furnace segment. The shell portion 27 is at the outer periphery, the stave 28 for cooling the furnace is engaged with an attachment metal piece 38, and bricks are laid on the inner side of the stave 28. The shell reinforcement member 39 is installed simultaneously with the stave 28. An end portion of an shell reinforcement member 39 in a rod-like shape may be engaged with a furnace inner side of the stave attachment metal piece 38 (for example, a bolt) by a turnbuckle 40 or a weld joint (not illustrated). Further, positions for engaging the shell reinforcement member 39 are disposed at both ends thereof and opposed to each other at an angle of 180 degrees relative to the center of the ring as shown in FIG. 20. Although in this example the number of shell reinforcement members 39 is 4, the number is not limited but may be at least one. After the block has been installed, the rod-like shell reinforcement member 39 may be removed by drawing the shell reinforcement member 39 by rotating the screw portion of the turnbuckle 40 or cutting the periphery of the weld joint by a simple cutter. In this way, the rod-like shell reinforcement member 39 can be removed at a position not directly related to the shell portion 27 and therefore, the shell portion 27 is not damaged or destroyed. Further, the engagement is carried out by simple means and therefore the shell reinforcement member 39 can easily be removed.

Although we have primarily referred to relining the blast furnace, the method is naturally applicable similarly to cases of rebuilding or newly constructing a blast furnace, as previously described.

In this way, according to the invention, an integrated blast furnace segment constructed at a location other than the foundation of the blast furnace can safely and precisely be grounded on the casting floor. In the relining or construction or reconstruction of a blast furnace utilizing the casting floor, significant acceleration of construction can be achieved with significantly reduced expense.

Particularly, in relining a blast furnace, the troublesome and time-consuming operation of removing existing attached facilities can be saved. Warping or straining of brickwork portions can effectively be prevented. Deformation of the shell of the furnace can be prevented during transport, hanging and bonding operations. Further, by welding the shells in position from outside the furnace, dangerous working procedures at an elevated location, or within the furnace, can be significantly avoided.

What is claimed is:

1. Apparatus for relining or constructing a blast furnace, said blast furnace comprising a foundation, a surrounding building, a casting floor located in said building and a plurality of interconnected blast furnace segments joined to define a unitary space, comprising the combination of:

a hanging structure extending from an outer portion to an inner portion of said casting floor building;

a movable base mounted on rails slide installed at said hanging structure and movable back and forth between said outer and inner portions of said casting floor building;

a horizontally movable apparatus connected to said movable base for actuating and controlling movement of said movable base in a horizontal direction from outside to inside said building, and said movable apparatus having a plurality of hydraulic cylinders, said hydraulic cylinders being movable per se intermittently on said slide rails;

a grounding apparatus connected for grounding said blast furnace segments; and said grounding apparatus having a hanging base movable in an up and down direction by a plurality of sets of lift jacks installed at said movable base and installed with hangers connected for hanging said blast furnace segments one above the other.

2. A grounding apparatus for accurately depositing a heavy and delicate blast furnace integrated segment having an integrated shell, staves and associated components on a casting floor of a blast furnace having a casting floor building, said blast furnace having an elevated supporting structure, and for depositing said blast furnace integrated segment at a predetermined level and position on said casting floor, without damaging or destroying said segment, said ground apparatus comprising:

a hydraulic jack system attached to suspend said integrated segment from said elevated supporting structure and thereby to lift said segment and suspend it at the level of said casting floor, said jack system comprising a plurality of hydraulic rod structure lift jacks, and a laterally acting transport apparatus comprising a plurality of intermittently movable hydraulic cylinders connected to said blast furnace segment for laterally moving said jacked-up segment while it is jacked up on a movable carriage at said casting floor level, said hydraulic cylinders being attached to said movable carriage adjacent to said casting floor, thereby transferring said carriage and said blast furnace segment by laterally transferring said movable carriage on rails laid on said casting floor.

* * * * *

UNITED STATES PATENT AND TRADEMARK OFFICE

CERTIFICATE OF CORRECTION

PATENT NO. : 6,513,789 B2
DATED : February 4, 2003
INVENTOR(S) : Kimura et al.

It is certified that error appears in the above-identified patent and that said Letters Patent is hereby corrected as shown below:

Column 13,
Line 21, please change “rails slide” to -- slide rails --.

Signed and Sealed this

Twentieth Day of April, 2004

JON W. DUDAS
*Acting Director of the United States Patent and Trademark Office*